United States Patent [19]

Griffiths

[11] Patent Number: 4,836,812

[45] Date of Patent: Jun. 6, 1989

[54] STEERING SYSTEM FOR AUXILIARY MARINE ENGINE

[75] Inventor: John M. Griffiths, Fond du Lac, Wis.

[73] Assignee: Brunswick Corporation, Skokie, Ill.

[21] Appl. No.: 169,817

[22] Filed: Mar. 18, 1988

[51] Int. Cl.[4] ..... B63H 21/26

[52] U.S. Cl. ..... 440/61; 440/62; 440/63; 114/144 R

[58] Field of Search ..... 440/53, 61, 62, 63; 114/144 R, 146, 150, 147

[56] References Cited

U.S. PATENT DOCUMENTS

| | | | |
|---|---|---|---|
| 2,875,722 | 3/1959 | Post | 115/18 |
| 4,349,341 | 9/1982 | Morgan et al. | 440/51 |
| 4,482,331 | 11/1984 | Boda | 440/51 |
| 4,573,930 | 3/1986 | Queen | 440/63 |
| 4,592,732 | 6/1986 | Ferguson | 440/61 |
| 4,710,141 | 12/1987 | Ferguson | 440/61 |

FOREIGN PATENT DOCUMENTS

| | | | |
|---|---|---|---|
| 2031362 | 4/1980 | United Kingdom | 440/63 |

*Primary Examiner*—Sherman D. Basinger
*Assistant Examiner*—Stephen P. Avila
*Attorney, Agent, or Firm*—Andrus, Sceales, Starke & Sawall

[57] ABSTRACT

A steering system for controlling an auxiliary marine engine includes an auxiliary engine steering cable operably connected to the hydraulic cylinder of the steering system for the primary engine so that linear movement of the hydraulic cylinder results in movement of the steering cable and pivotal steering of the auxiliary engine.

3 Claims, 1 Drawing Sheet

STEERING SYSTEM FOR AUXILIARY MARINE ENGINE

BACKGROUND OF THE INVENTION

The present invention relates to a steering system for a marine engine and more specifically to a system for controlling the steering of an auxiliary engine through the steering system provided for the primary engine.

In boats that utilize a large horsepower primary engine, it is not unusual for there to be a secondary or auxiliary engine of much smaller horsepower that is utilized for trolling, docking or other low speed operations.

Typically, the auxiliary engine is mounted on the stern of the boat to the side of the centrally located primary engine and the steering of the auxiliary engine could be performed in one of two ways. First, the operator of the boat could leave the forwardly located steering wheel and proceed to the stern of the boat where he would manually steer the auxiliary engine through the use of a handle. In the alternative, the operator could steer the auxiliary engine through the use of the steering wheel if a cable system for the auxiliary engine could be coupled into the cable steering system for the primary engine.

Neither of these methods provided for steering of an auxiliary engine through the use of a steering wheel that formed part of a hydraulically activated steering system.

SUMMARY OF THE INVENTION

A steering system for controlling an auxiliary marine engine includes a steering wheel located on the boat at a point remote from the primary engine. Operation of the steering wheel results in the movement of hydraulic fluid through a cylinder whose resulting linear movement results in a pivotal steering movement of a primary engine.

In accordance with one aspect of the invention, the cable steering system for an auxiliary engine is operably connected to the cylinder so that linear movement of the cylinder results in linear movement of the steering cable which in turn results in a pivotal steering movement of the auxiliary engine.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
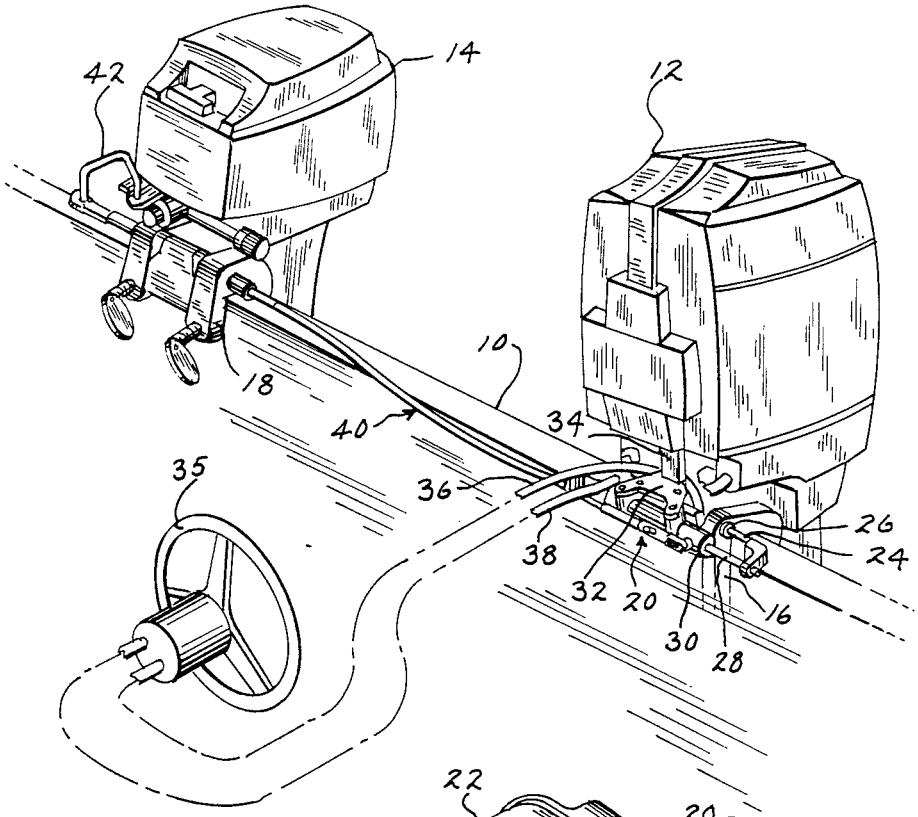
FIG. 1 is a perspective view of a primary and auxiliary marine engine steering system constructed according to the invention.

As seen in FIG. 1, a boat having a stern 10 is provided with a high horsepower primary engine 12 and a smaller horsepower secondary or auxiliary engine 14. Both of which are mounted on stern 10 by means of mounting clamps 16 and 18.

A hydraulic steering system 20 is utilized for steering primary engine 12 and includes a stationary bracket 22 having an outer rod 24 that passes through tilt tube 26 of primary engine 12. Bracket 22 further includes an inner rod 28 on which hydraulic cylinder 30 is mounted for linear sliding movement.

Hydraulic cylinder 30 is provided with a mounting plate 32 to which the steering arm 34 of primary engine 12 is attached so that linear movement of cylinder 30 is translated into pivotal movement of primary engine 12.

The linear movement of hydraulic cylinder 30 is controlled by steering wheel 35 located at a point remote from stern 10. Movement of steering wheel 35 controls the flow of hydraulic fluid in conduits 36 and 38 which determines the movement of hydraulic cylinder 30. The hydraulic steering system is well known in the marine art and therefore, detailed workings and operation of the steering system will not be described in detail here.

The steering of auxiliary engine 14 by steering wheel 35 is accomplished by providing a steering cable 40 which has one end attached to steering arm 42 of auxiliary engine 14 and has the other end operably connected to steering system 20.

Figure 2:
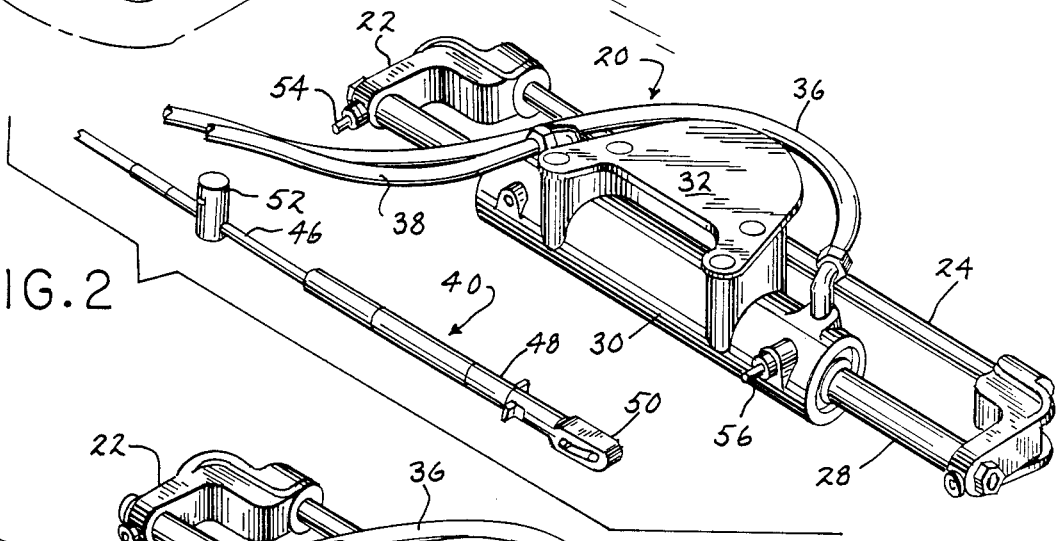
FIG. 2 is a perspective exploded view of the connection between the auxiliary steering cable and the steering system.

As seen in FIG. 2, cable 40 includes an inner steering cable which is co-axial with and contained within outer sleeve 46. The outer end of the inner steering cable terminates in a jacket 48 having a hole bearing socket 50. A hole bearing cylinder 52 is fixedly mounted on a portion of outer sleeve 46. In the embodiment shown in FIG. 2, cable 40 is attached to steering system 20 by securing cylinder 52 to pin 54 that is mounted on stationary bracket 22 and by attaching socket 50 to pin 56 that is mounted on and extends from hydraulic cylinder 30. When mounted in this fashion, linear movement of hydraulic cylinder 30 will cause the inner steering cable to move within sleeve 46. This linear movement of the inner cable causes linear movement of the cable end attached to steering arm 42 and thus causes pivotal steering movement of auxiliary engine 14.

Figure 3:
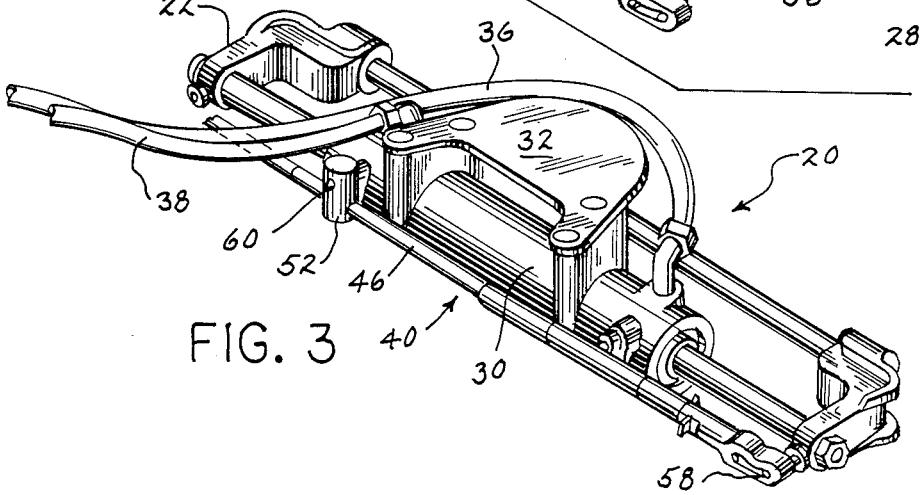
FIG. 3 is a perspective view of an alternate method of connecting the auxiliary steering system to the steering system.

FIG. 3 illustrates an alternate method of attaching cable 40 to steering system 20. In this method, the inner cable is mounted to stationary bracket by means of pin 58 and sleeve 46 is mounted to a hydraulic cylinder 30 by means of a pin 60. Movement of hydraulic cylinder 30 results in relative movement of the inner cable.

The present invention thus provides a steering system for an auxiliary engine that can be readily connected to and utilized with the hydraulic steering system for the primary engine.

It is recognized that various alternatives and modifications are possible in the scope of the appended claims.

I claim:

1. A steering system for controlling an auxiliary marine engine that is pivotally mounted to the stern of a boat, said system comprising:

steering means disposed on the boat at a point remote from a primary engine pivotally mounted about a first vertical axis on the stern of the boat, a hydraulically operable cylinder unit including a cylinder member and a rod member, a first of said members being slidable in a linear direction relative to a second of said members, said cylinder unit being operably connected to the primary engine so that linear movement of said first member results in pivotal movement of said engine, hydraulic conduit means operably connecting said steering means to said hydraulic cylinder unit so that movement of said steering means results in linear movement of said first member, flexible steering cable means including an inner cable and an outer sleeve, said cable being operably connected to the auxiliary engine so that linear movement of said cable results in pivotal movement of the auxiliary engine about a second vertical axis spaced from said first axis, and mounting means for operably connecting said flexible cable to one of said members and said sleeve to the other of said members whereby linear movement of said first member will cause movement of said cable relative to said sleeve to pivot said auxiliary engine about said second axis.

2. The steering system defined in claim 1, wherein said cylinder member constitutes said first member and said rod member constitutes said second member, said mounting means comprises coupling means for securing said sleeve to said rod member and attachment means for connecting said inner cable to said cylinder member.

3. The steering system defined in claim 1, wherein said cylinder member constitutes said first member and said rod member constitutes said second member, and said mounting means comprises holding means for securing said inner cable to said rod member and fastening means for connecting said sleeve to said cylinder member.

* * * * *